US005273160A

United States Patent [19]

Malvasio

[11] Patent Number: 5,273,160

[45] Date of Patent: Dec. 28, 1993

[54] AIR-TIGHT PAINTING TOOL CONTAINER

[76] Inventor: William A. Malvasio, 608 S. Browns Lake Dr., Burlington, Wis. 53105

[21] Appl. No.: 14,728

[22] Filed: Feb. 8, 1993

[51] Int. Cl.[5] ..... B65D 25/04; B44D 3/12

[52] U.S. Cl. ..... 206/362; 206/459.5; 206/561; 220/570

[58] Field of Search ..... 206/362, 15.2, 459.5, 206/561, 564, 563; 220/570, 555, 735, 736; 15/257.06

[56] References Cited

U.S. PATENT DOCUMENTS

| | | | |
|---|---|---|---|
| 1,383,570 | 7/1921 | Schnell | 206/561 X |
| 1,595,965 | 8/1926 | Johnson | 15/104.1 |
| 1,954,224 | 4/1934 | Piker | 206/561 X |
| 2,211,869 | 8/1940 | Tobita | 206/459.5 |
| 2,521,122 | 9/1950 | Lambourne | 15/257.06 |
| 2,838,781 | 6/1958 | Molle | 15/121.1 |
| 2,909,797 | 10/1959 | White | 15/121.2 |
| 3,009,564 | 11/1961 | Geloso | 206/561 X |
| 3,250,283 | 5/1966 | Reinfeld | 206/459.5 X |
| 3,394,861 | 7/1968 | Truox | 220/555 X |
| 4,010,866 | 3/1977 | McClane | 220/20 |
| 4,162,005 | 7/1979 | Linger | 206/362 |
| 4,353,694 | 10/1982 | Pelerin | 206/561 X |
| 4,547,926 | 10/1985 | Kern | 15/257.06 |
| 4,651,379 | 3/1987 | Kern | 220/570 X |
| 4,658,957 | 4/1987 | Guth et al. | 206/563 X |
| 4,669,609 | 6/1987 | Lugo | 206/229 |
| 5,085,317 | 2/1992 | Jensen | 206/362 X |
| 5,123,576 | 6/1992 | Lawrence | 15/257.06 X |

FOREIGN PATENT DOCUMENTS

| | | | |
|---|---|---|---|
| 0496042 | 9/1953 | Canada | 206/362 |
| 4023863 | 2/1992 | Fed. Rep. of Germany | 206/362 |
| 1093203 | 11/1954 | France | 15/257.06 |

*Primary Examiner*—Paul T. Sewell
*Assistant Examiner*—Ted Kavanaugh
*Attorney, Agent, or Firm*—Arthur J. Hansmann

[57] ABSTRACT

An air-tight paint tool storage container for receiving a paint roller, a paint brush, and a paint pad. The container has a base with a horizontal and planar floor with the respective words for the tools imposed thereon. Partitions extend in the base for dividing the base into respective areas for receiving the respective tools.

8 Claims, 3 Drawing Sheets

AIR-TIGHT PAINTING TOOL CONTAINER

This invention relates to an air-tight painting tool container, and, more particularly, it relates to a painting tool storage container which has various areas for receiving painting tools such as a roller, brush, and painting pad.

BACKGROUND OF THE INVENTION

It is well known that when a painter is painting, he may very well arrive at a time when he stops painting for a long interval, such as for overnight, but his brush, roller, and paint pad are still loaded with paint. Under those ordinary circumstances, he must somehow clean or store his tools so that they will again be ready to be used when he resumes painting. It is of course a chore and involves time and expense to clean the tools to a condition where they are freed of the paint and therefore pliable and ready for fresh use upon resuming painting.

The present invention obviates the requirement for cleaning the paint from the tools when interrupting the painting, and this is basically accomplished by providing an air-tight storage container for receiving the tools so that they can be stored at a length of time, such as overnight, without having the residual paint that is on the tools dry and harden and thereby render the tools unusable.

The prior art is already aware of storage and other receptacles for receiving paint tools, and U.S. Pat. No. 4,547,926 shows an airtight storage container. Further, U.S. Pat. Nos. 2,838,781 and 2,909,797 and 4,010,866 and 4,669,609 show tool trays which are compartmentalized for receiving various tools for painting or the like.

The present invention differs from the prior art in that it provides an air-tight storage container which has a planar floor having wordings thereon for designating the storage location of the paint roller, and the paint brush, and the paint pad, and the arrangement is such that the storage container is of a minimum size, but can store these tools which are of maximum conventional size and do so in the most efficient manner. Further, the present container is arranged so that it can be readily cleaned of the paint deposited therein by those tools, and this is achieved because the floor is not interrupted with any pockets or reservoirs for receiving these tools nor does it have any clips thereon and which must therefore be cleaned around and through when the container is to be cleaned. Accordingly, the present invention can be manufactured by means of simplified manufacturing processes, such as molding or stamping for complete presentation of the item, and additional clips, such as in U.S. Pat. No. 4,547,926 need not be applied, but the tools in the present invention will nevertheless be retained securely in their positions without sliding around in the container which can be carried and tipped without upsetting the location of the tools. Still further, the container is arranged so that tools of various sizes can be stored in their respective storage areas, and all three types of the aforementioned tools are specifically and specially stored in the container of this invention. Accordingly, these aforementioned features provide for the creation of a container which is smaller and more versatile than those of the prior art, and this container is less expensive to produce and to ship and is therefore more appealing to the user.

More specifically, the present invention is unique in that it provides an air-tight container which has separated areas for storage of several different types of painting tools, and these areas are provided by partitions and cradles which are an integral part of the container. As such, the tools are kept separated and in place without the use of fasteners or reservoirs or depressions for receiving the tools, all as shown in the prior art mentioned herein. Further, the container of this invention has its partition and cradle arranged so that it can accommodate tools of different shapes and sizes, namely, one size receives all.

Finally, the container of this invention has words imposed thereon so that the user will know the precise positioning for the roller and the brush and the pad, and those three areas are physically separated from each other by the structure of the container, and thus different color paints can actually be on the various tools but the paints will not run into each other to contaminate a tool of one color by the different color paint from another tool. Also, all of the painting ends of the tools, such as the bristles and the roller and the pad itself are all disposed adjacent the side walls of the container, rather than to the interior of the container and thus toward each other, and the location of the words is such that it assists in that desirable placement of the tools. These features persist, even though the tools themselves may be of various sizes, such as the length of the roller itself and the width of the paint brushes and the pad. To further accommodate the feature of the absence of the paint running from one tool to another when placed in the container, the container is a horizontally planar on the bottom surface, rather than any inclined surfaces or wells toward which the paint could run.

Accordingly, the container has a lid which is completely removable, rather than being hinged thereto, and thus the lid can be set aside when the base of the container is to be accessible. When the tools are in the base and the lid is applied in the air-tight relationship, then the tools can be retained therein for short periods of time, without drying or hardening, and that time may be sufficient for a break from painting, a change of shifts, or even an overnight hiatus.

DETAILED DESCRIPTION OF THE PREFERRED EMBODIMENT

Figure 1:
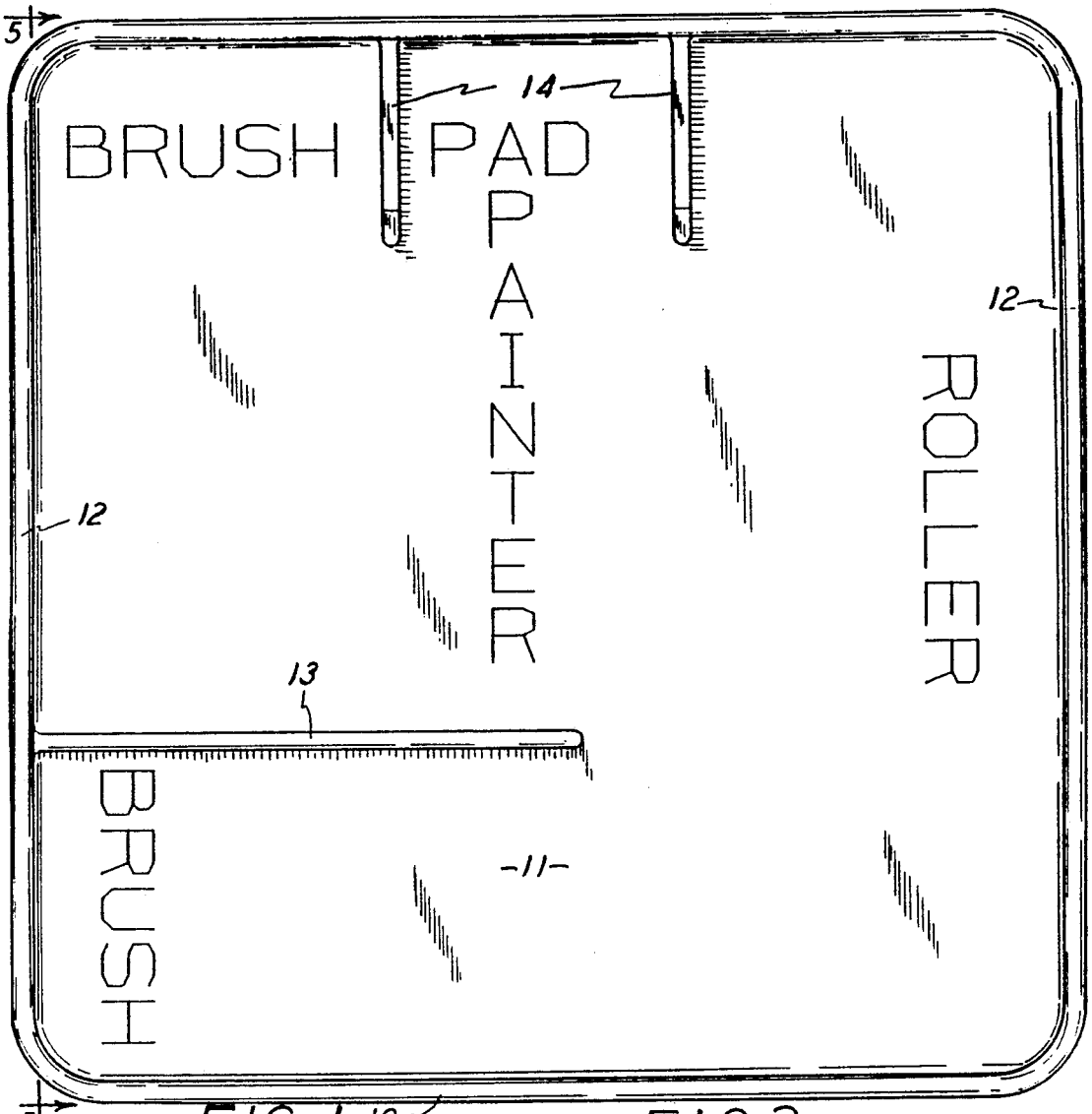
FIG. 1 is a top plan view of the base portion of the container of this invention.

FIG. 1 is a view looking down into the base 10 which has the horizontally and planar disposed bottom 11 and the four upstanding side walls 12 which extend around the outer edges of the bottom 11. Of course the base 10 is all of one integral piece and it also includes the upstanding partition 13 and the paint pad cradle 14 which is presented by way of two upstanding walls designated 14.

FIG. 1 further shows that the planar bottom 11 has words "roller" and "pad" and the two locations of the word "brush" and the word "painter" thereon. These words are preferably embossed in the bottom surface 11, and the entire base 10 can be made from a molding process so that it would be preferably made of a plastic material.

Figure 3:
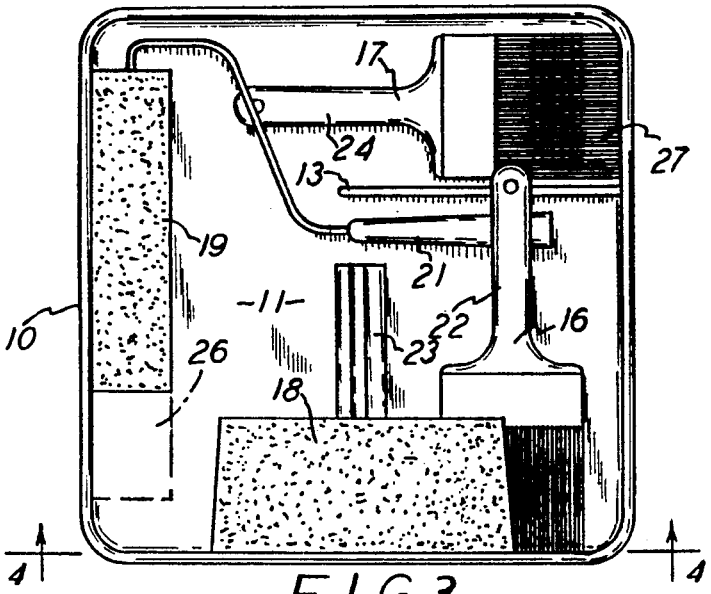
FIG. 3 is a top plan view on a reduced scale, and similar to FIG. 1, but has the paint tools shown therein.

With the arrangement described, the three paint tools can be disposed in the base 10 in the location of the three respective words therein, and such positioning of the tools can be as shown in FIG. 3. In fact, there can be two paint brushes, as shown in FIG. 3, and there can actually be two or more brushes on top of each of the two brushes shown in FIG. 3, and there can even be another paint pad on top of the pad shown in FIG. 3, and this is referring to brushes 16 and 17 and paint pad 18. FIG. 3 further shows that there is a conventional paint roller 19 which is disposed in its designated position on the floor 10, and it has its handle 21 extending centrally of the base 10, as shown in FIG. 3.

Figure 4:
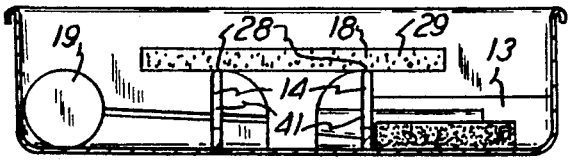
FIG. 4 is a sectional view taken along the line 4—4 of FIG. 3.
Figure 5:
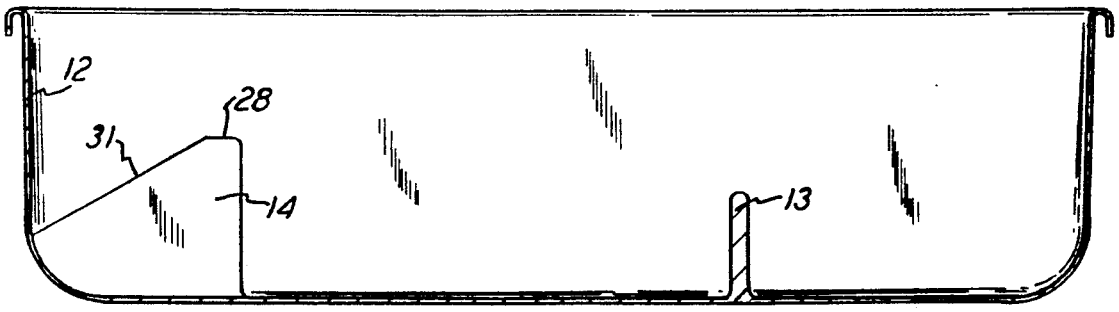
FIG. 5 is a sectional view taken along the line 5—5 of FIG. 1.

In the entire arrangement of the tools as seen in FIG. 3, the painting end of each of the tools is disposed toward the outer wall 12 of the base 10, and thus away from each respective tool so that different colors may exist on the tools, but their colors will not run into each other, and this is true with respect to the pad 18 which is in an elevated position on its cradle 14, as particularly seen in FIG. 4.

Again, the tool handles, such as the handle 22 of the brush 16 and the handle 23 of the pad 18 extend in the interior of the base 10 and parallel to each other, and the roller handle 21 and the handle 24 of the brush 17 also extend to the interior of the base 10 and are parallel to each other.

FIG. 3 further shows that the roller 19 can be of an extended length, such as the dot-dash portion 26 of the cylindrical roller portion wherein the complete roller 19 would then be longer than the one shown in solid lines in FIG. 3, and the base 10 would also accommodate the longer roller. Likewise, the brushes 16 and 17 and the pad 18 can be of various sizes, and the display in FIG. 3 is showing the brush 17 of a large size type of brush as is apparent by the display of the brush bristles 27.

To further assist and designate the location of the painting end of the tools, FIG. 1 shows that the four words are located adjacent the respective upstanding side walls 12 of the base 10. FIG. 4 shows that the upper pad surface 28 is at an elevation above the floor 11 such that the pad applicator portion 29 is above the elevation of the brush 16 and of the roller 19, and, in fact, the cradle 14 serves as a partition or wall for the brush 16 to confine the brush 16 in the location shown.

Figure 7:
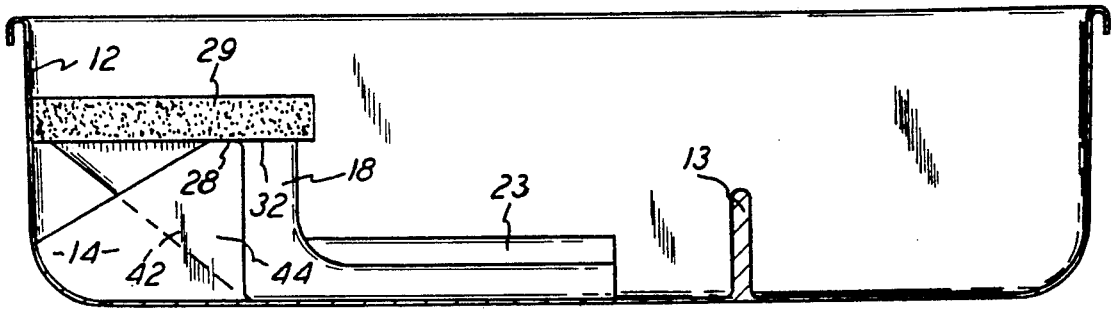
FIGS. 7 and 8 are sectional views similar to FIG. 5, but showing two different paint pads therein.
Figure 8:
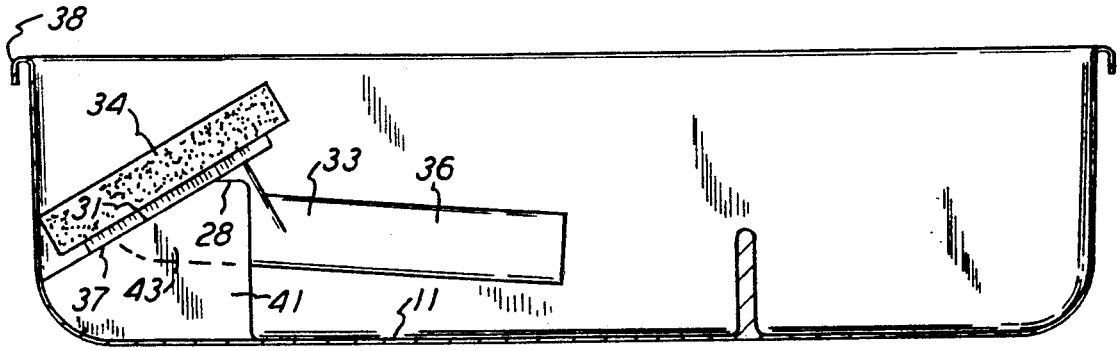

FIGS. 7 and 8 show that the pad cradle 14 has two upper surfaces 28 and two upper surfaces 31, and these surfaces respectively support a pad of different configuration. That is, FIGS. 3, 4, and 7 show one pad 18 of one configuration having its under surface 32 resting on the cradle upper surface 28, and the pad handle 23 then rests on the floor 11. Next, FIG. 8 shows a different pad 33 which has its painting end portion 34 at an oblique angle with respect to its handle 36, and thus is of a different configuration than the pad 18, and, in that instance, the pad 33 has its under surface 37 resting downwardly on the cradle angulated surface 31. Therefore, it will be seen and understood that the cradle 14 has two upwardly-faced surfaces 28 and 31 which are oblique to each other and the surface 31 is therefore at an angle with respect to the planar extent of the base bottom 11. With that arrangement, the base 10 can receive either pad 18 or 33 which are conventionally-shaped pads in commercial use today.

Figure 6:
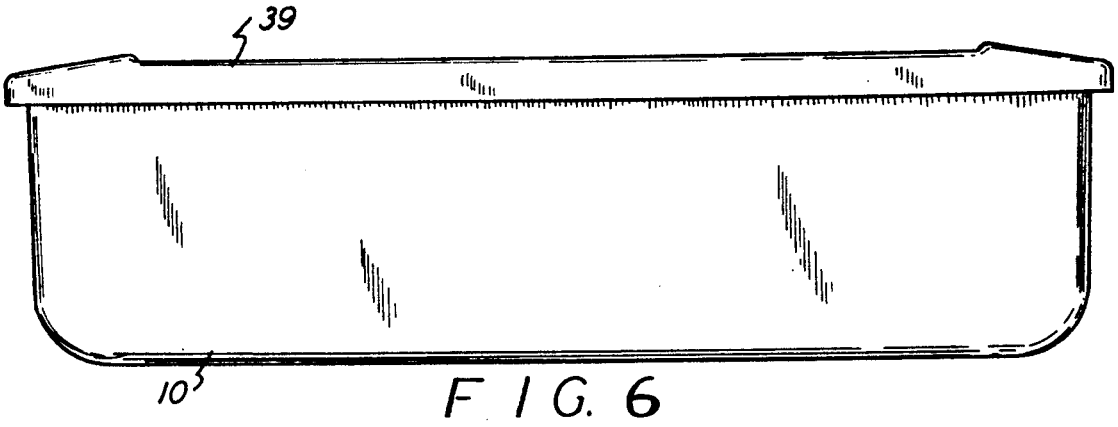
FIG. 6 is an end elevational view of the assembled container with the base and the top.
Figure 9:
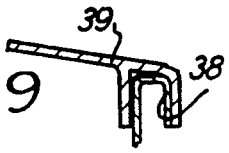
FIG. 9 is an enlarged sectional view of a portion of FIG. 8, but with the portion of the container top added thereto, as indicated in FIG. 6.

The entire container is made of a thin wall material, such as seen in the section views, and the upper edge of the base 10 has a downturned peripheral edge 38 extending endlessly therearound and FIG. 6 shows a cover or top 39 which extends over the entire base 10 and mates with the downturned edge 38, as shown in FIG. 9, to be air-tight with the base 10.

Figure 2:
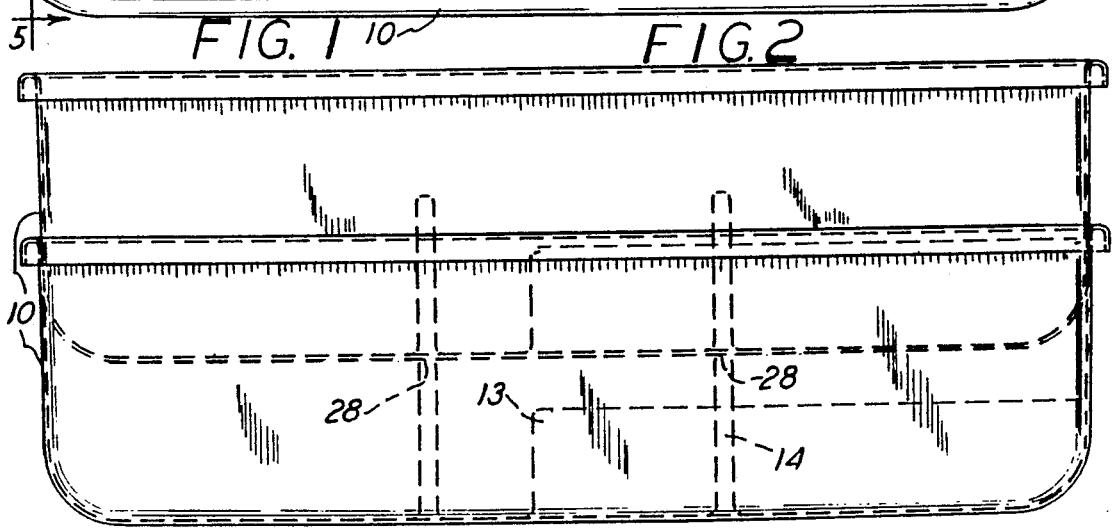
FIG. 2 is a side elevational view of two containers shown in FIG. 1, and showing them in stacked relationship.

FIG. 2 shows two bases 10 which are shown nested together for stacking and general storage purposes, and therefore the side walls 12 are at a slight or draft angle such as common in a molding process for permitting the stacking shown in FIG. 2. The upper base 10 will penetrate the lower base 10 to the location of the upper edges 28 of the pad cradle 14.

Accordingly, the container includes the base 10 and the cover 39 which are in air-tight relationship, and the base 10 includes the several areas designated by the words mentioned, all for the purpose of displaying the locations of the various paint tools. In all instances, the areas for the two brushes 17 are segregated from the remainder of the base 10, as mentioned, and the roller 19 is also segregated by virtue of the pad partition 14. With that arrangement, the various tools do not come in contact with each other and they can actually be laden with paints of different colors which will not combine because of the segregation mentioned. To further accomplish the compact arrangement shown and described, the pad cradle 14 is located centrally on one of the walls 12 and spaced from the two adjacent side walls 12, and the brush 16 and roller 19 are actually also extending adjacent the pad support wall 12 but are on opposite sides of the pad support 14 and the cylindrical portion of the roller 19 extends along the wall shown adjacent thereto and thus its handle 21 is adjacent the pad handle 23 but at right angles thereto, all for compactness and stability of the tools therein.

The drawings further show that the base 10 is square in plan shape, and this further accommodates the compactness and security of the entire arrangement, and the floor 11 is on one plane and thus the paint from any tool will not be inclined to run in a direction away from the tool itself.

The pad cradle 14 is provided in the two spaced-apart upstanding walls 41 and thus the handles for the respective conventionally-shaped pads 18 and 33 are received between the spaced-apart walls 41 and the pads are thus securely positioned on the respective upper surfaces 28 and 31.

FIGS. 7 and 8 show the respective pad handle portions 42 and 43 in their extents between the pad upstanding partitions 41.

What is claimed is:

1. An air-tight container for paint brushes, pads, and rollers, comprising a combined base and cover, said base and said cover each having an endless periphery in contact with each other and having air-tight mating surfaces along the entire lengths of said peripheries and with said cover being removable from said base, said base having a hollow interior and a horizontally disposed floor extending along a plane and having upstanding side walls at the periphery of said floor for circumscribing said interior of said base, a paint pad support attached to said base and extending uprightly in said hollow interior and having an upper surface spaced from said floor for supporting a paint pad at an elevation above said floor and including two uprightly extending sides oppositely disposed on said support, said upper surface of said pad support includes two planar areas disposed on two respective upwardly faced intersecting planes which are angulated relative to each other and with both said planar areas being faced away from said floor and with one lying on a plane angulated relative to said plane of said floor and being nearer said one wall and angulated to be closer to said floor in that part of its said area which is adjacent said one wall, the other of said planar areas lying on a plane parallel to said floor, said planar areas are arranged to respectively and mutually exclusively upwardly support paint pads of two different shapes, said floor having two areas respectively disposed adjacent said opposite sides of said paint pad support and with each said floor area being arranged to respectively support a paint roller and a first paint brush, said pad support being located centrally on one of said walls and spaced from the two of said walls which are adjacent to said one wall and being arranged to demark and isolate the said two floor areas relative to the remainder of said floor for isolated reception of said roller and said first brush in said two floor areas, and with the words "ROLLER" and "BRUSH" respectively imposed upon said two areas of said floor for respectively identifying said two floor areas for the location of said roller and said first brush in said base, and with the work "PAD" imposed relative to said pad support for identifying said pad support for said pad in said base.

2. The air-tight container for paint brushes, pads, and rollers as claimed in claim 1, wherein said base includes an uprightly disposed partition extending spaced from one of said walls and for defining a third floor area for reception of a second brush and being located in a position to isolate said third floor area from the remainder of said floor of said base.

3. The air-tight container for paint brushes, pads, and rollers as claimed in claim 1, for receiving a conventional paint pad having a handle, wherein said pad support is adjacent to one of said walls and extends therealong for a distance less than the length of said one wall, and said support consists of two spaced-apart walls with a space therebetween for receiving said handle of a conventional paint pad.

4. The air-tight container for paint brushes, pads, and rollers as claimed in claim 1, for receiving a conventional paint pad and a conventional roller, each having a conventional handle, wherein said two areas and said wordings for said pad and said roller are located adjacent each other and along respective lengths of two adjacent ones of said walls and thereby are arranged to have said conventional handles of said pad and said roller disposed at right angles to each other.

5. The air-tight container for paint brushes, pads, and rollers as claimed in claim 1, for receiving a roller and a pad with each having a handle, wherein said floor is rectangularly shaped and said walls are affixed thereto at the periphery of said floor, and said area supporting said roller extends along the entire length of a first one of said walls, and said pad support is contiguous to a second one of said walls which is adjacent said first one of said walls, said floor having a geometric center equidistant from all of said walls, and all being arranged to receive said handles of said roller and said pad adjacent each other at said center of said floor.

6. The air-tight container for paint brushes, pads, and rollers as claimed in claim 5, wherein said base includes a partition extending spaced from a third one of said walls and for defining an area on said floor for reception of a second brush and being located to isolate said second brush area from the remainder of said floor of said base.

7. The air-tight container for paint brushes, pads, and rollers as claimed in claim 6, wherein said second wall and said third wall are located opposite each other on said floor and with said partition being located between the floor area for said pad support and said floor area for said second brush.

8. The air-tight container for paint brushes, pads, and rollers as claimed in claim 7, wherein said floor is rectangular in shape and said pad support and said partition extend along said floor for less than the length of the margins of said floor and thereby extend for only limited extents and being arranged to create four areas on said floor, two of said areas being shaped for said two brushes and the other two of said areas being shaped for said roller and said pad.

* * * * *